US006977331B2

(12) United States Patent
Lin

(10) Patent No.: US 6,977,331 B2
(45) Date of Patent: Dec. 20, 2005

(54) SAXOPHONE WINDPIPE STRUCTURE

(75) Inventor: Wei-Fu Lin, Taichung (TW)

(73) Assignee: Chia-Chun HSU, Taipei (TW)

( * ) Notice: Subject to any disclaimer, the term of this patent is extended or adjusted under 35 U.S.C. 154(b) by 0 days.

(21) Appl. No.: 10/849,862

(22) Filed: May 21, 2004

(65) Prior Publication Data

US 2005/0257662 A1 Nov. 24, 2005

(51) Int. Cl.[7] ..... G10D 7/08

(52) U.S. Cl. ..... 84/385 R

(58) Field of Search ..... 84/385 R, 380 R, 84/386, 385 A, 387 R

(56) References Cited

U.S. PATENT DOCUMENTS 2,425,796 A * 8/1947 Gillespie ..... 84/385 R
2,846,917 A * 8/1958 Lefevre-Selmer ..... 84/385 R
3,136,199 A * 6/1964 Leblanc ..... 85/385 R

* cited by examiner

*Primary Examiner*—Kimberly Lockett

(57) ABSTRACT

The present invention relates to a mouth-tube assembled to a tip of a saxophone wind tube, an operating rod is installed on an upper portion of the mouth-tube. The feature of the invention is that: a cover tube, having a spiral spring inserted therein, protruding downwards is installed on a lower end of the operating rod, furthermore, the spiral spring protrudes from the cover tube and is leaned on the mouth-tube. According to the aforesaid structure, the conventional spring plate is replaced with a spiral spring to reduce hole drilling and screwing process, whereby structure and production process is simplified, achieving a decrease in capital.

1 Claim, 4 Drawing Sheets

SAXOPHONE WINDPIPE STRUCTURE

BACKGROUND OF INVENTION a) Field of the Invention

The present invention relates to an improved structure of a saxophone windpipe, particularly to replace the conventional spring plate with a spiral spring to reduce hole drilling and screwing action, thus simplifying the structure and production process, achieving decrease in capital of the windpipe structure.

b) Description of the Prior Art

The saxophone used in jazz music is primary formed by a saxophone wind tube, a mouth-pipe and a mouth. Wooden pieces are installed on the mouth. By blowing the pieces to vibrate, sound will be emitted.

Referring to FIG. 4, a high pitch hole a1 and a tube seat a2 is installed on a mouth-tube. Further, a middle part of an operating rod b has two sides protruding downwards where an ear seat b1 is formed, enabling the operating rod b and a tube seat a2 on the mouth-tube a to connect. A spring plate c is assembled on a lower end of the operating rod b; the lower portion of the spring plate c is leaned against the mouth-tube a. A key cover b2 is formed on an inner tip of the operating rod b, moreover, a guide seat a3 is installed on an upper portion of the mouth-tube a in front of a high pitch hole a1, thus the operating rod b is supported by the guide seat a3, enabling the key cover b2 to press on the high pitch hole a1. Further, a ring cover b3 is formed on a lower portion of the operating rod b, encircling a lower portion of the mouth-tube a, moreover, a push rod d2 connecting a high pitch key d1 is assembled on an upper portion of a saxophone wind tube d; the push rod d2 is leaned against the inner side of the ring cover b3. Thus, by pressing the high pitch key d1, the push rod d2 will push the operating rod a1; thereby the key cover b2 on the upper portion of the operating rod b is no longer pressed on the high pitch hole a1, emitting a high pitch. When the high pitch key d1 is released, the operating rod b will move back to its original position by the spring plate c1, enabling the key cover b2 on the operating rod b to be pressed against the high pitch hole a1, emitting a low pitch.

Moreover, the aforesaid spring plate c is screwed on the operating rod b by drilling a hole on an inner side of the operating rod b and a hole on a side of the spring plate c. Before the spring plate c is installed, the spring plate c is bent into an arc shape to a fixed angle to maintain stableness of tension. The process of production is complex, and the stability is difficult to control. Furthermore, the spring plate loses its flexibility after a period of time; thereby in conclusion to the above, the conventional structure of wind tube is fairly complicated, and process of production is complex, thus, capital is increased enabling decrease in market competition.

SUMMARY OF THE INVENTION

The object of the invention is to provide an improved structure of a saxophone windpipe, particularly to replace the conventional spring plate with a spiral spring to reduce hole drilling and screwing action, thus simplifying the structure and production process, achieving decrease in capital of the windpipe structure.

In order to achieve the above object, the present invention provides a mouth-tube on an upper portion of a saxophone wind tube. An operating rod is assembled on the mouth-tube. A tube seat is disposed on a lower protruding portion of the operating rod. A spiral spring is inserted in the tube seat; moreover, the spiral spring is protruding from the tube seat and leaned against the mouth-tube.

To enable a further understanding of the said objectives and the technological methods of the invention herein, the brief description of the drawings below is followed by the detailed description of the preferred embodiments.

DETAILED DESCRIPTION OF THE PREFFERED EMBODIMENTS

Figure 1:
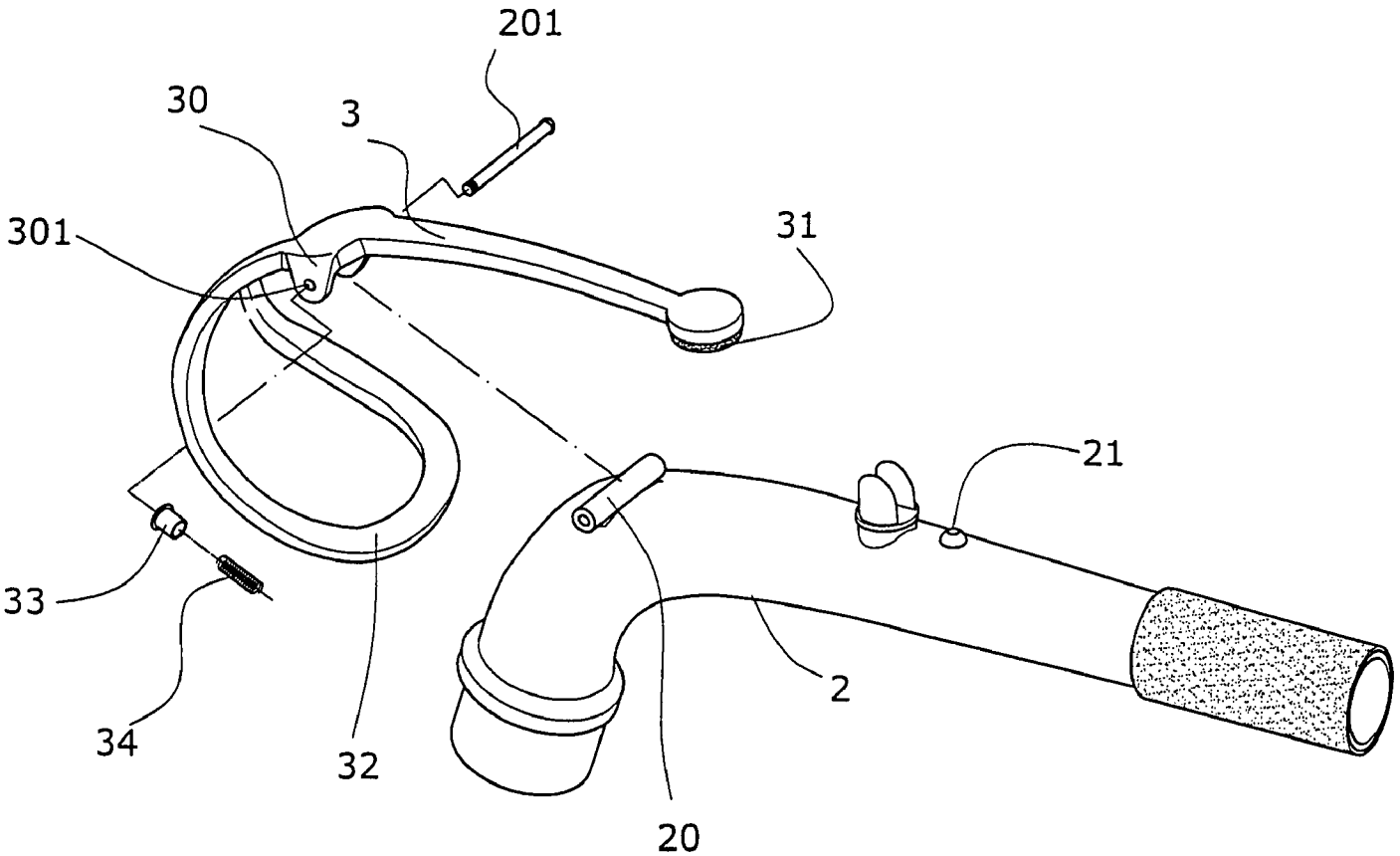
FIG. 1 is a perspective exploded view of the invention.
Figure 2:
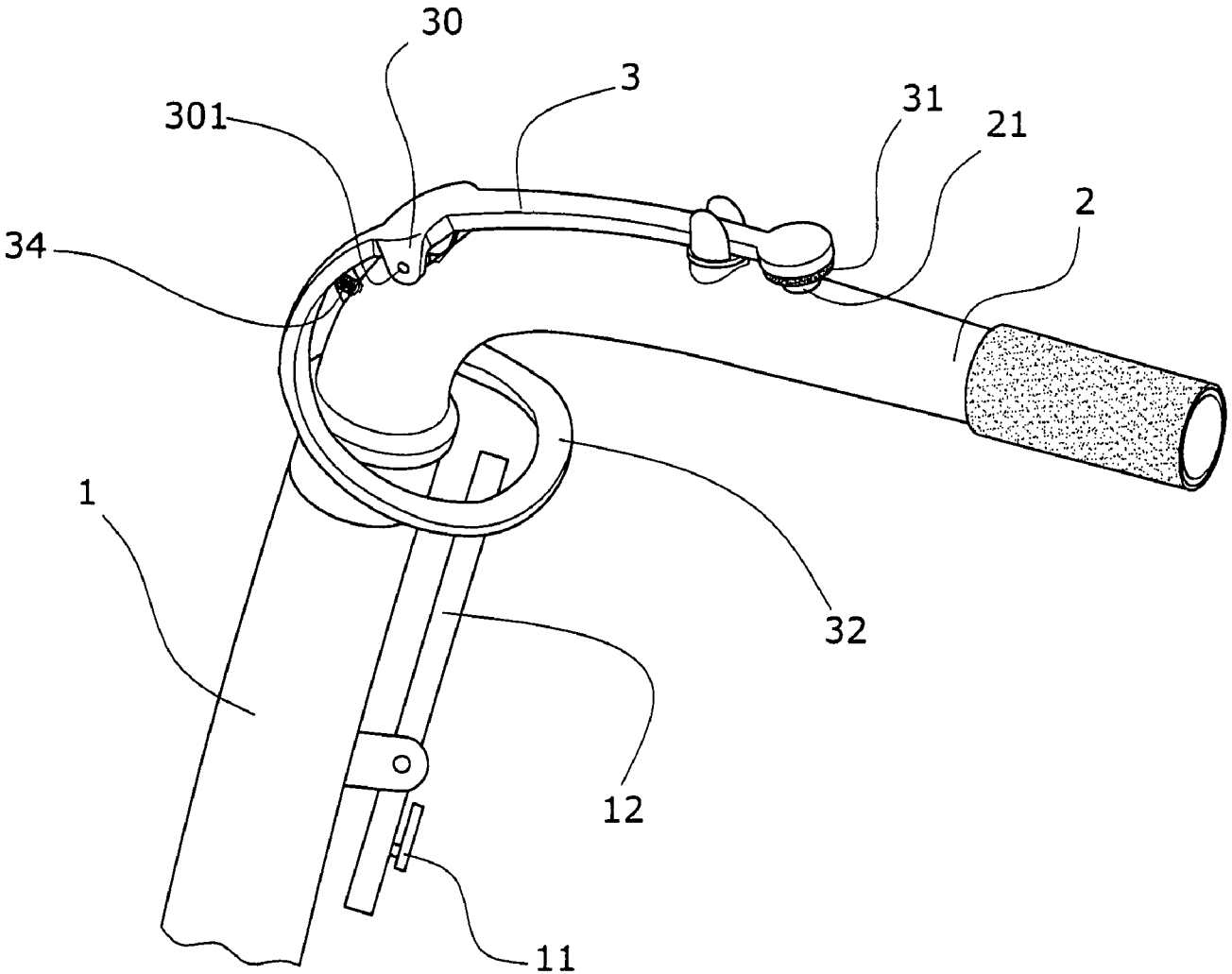
FIG. 2 is a perspective schematic view showing the present invention in assembled state.

With reference to FIGS. 1 and 2, the present invention mainly consists of a mouth-pipe 2 connecting to a tip of a saxophone wind tube 1, a high pitch hole 21 and a tube seat 20 is disposed on the mouth-pipe 2. A middle part of an operating rod 3 has two sides protruding downward where an ear seat 30 is installed. A small aperture 301 is formed on the ear seat 30 where an inserting pin 201 is inserted with the tube seat 20, connecting the mouth-tube 2 with the operating rod 3. A key cover 31 is formed on an inner tip of the operating rod 3; the key cover 31 is pressed against a high pitch hole 21. A ring holder 32 is formed on a base of the operating rod 3, encircling a lower end of the mouth-tube 2. Moreover, a push rod 12 connecting a high pitch key 11 is assembled on an upper side of the saxophone wind tube 1; the push rod 12 is leaned against an inner side of the ring holder 32. The feature of the invention is that:

- a cover tube 33 protruding downwards is installed on a lower portion corresponding to where the operating rod 3 and the mouthpiece 2 is connected; wherein, a spiral spring 34 is inserted in the cover tube 33. Moreover, the spiral spring 34 protrudes from the cover tube 33 whilst leaning on an upper end of the mouth-tube 2.

Figure 3:
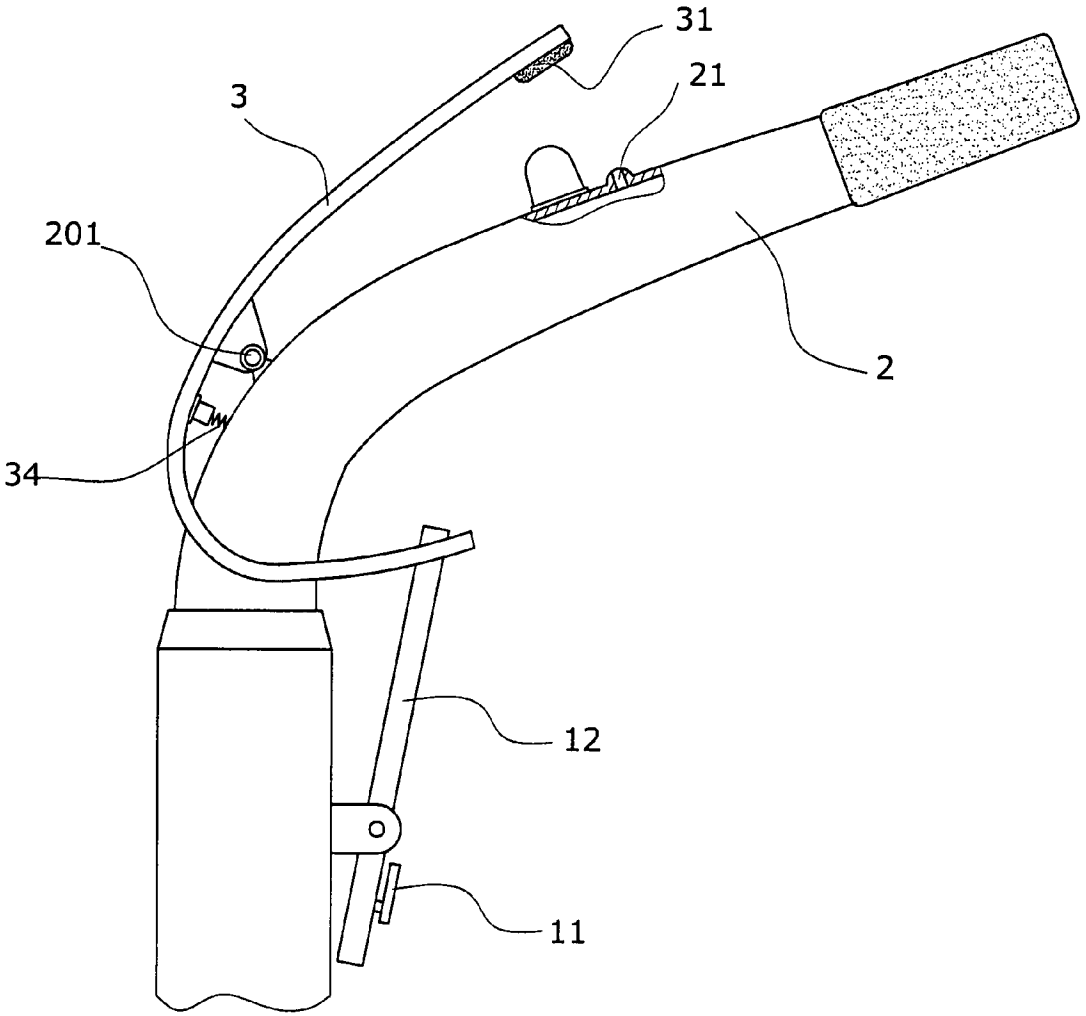
FIG. 3 is a schematic view illustrating the high pitch key being pressed according to the present invention.
Figure 4:
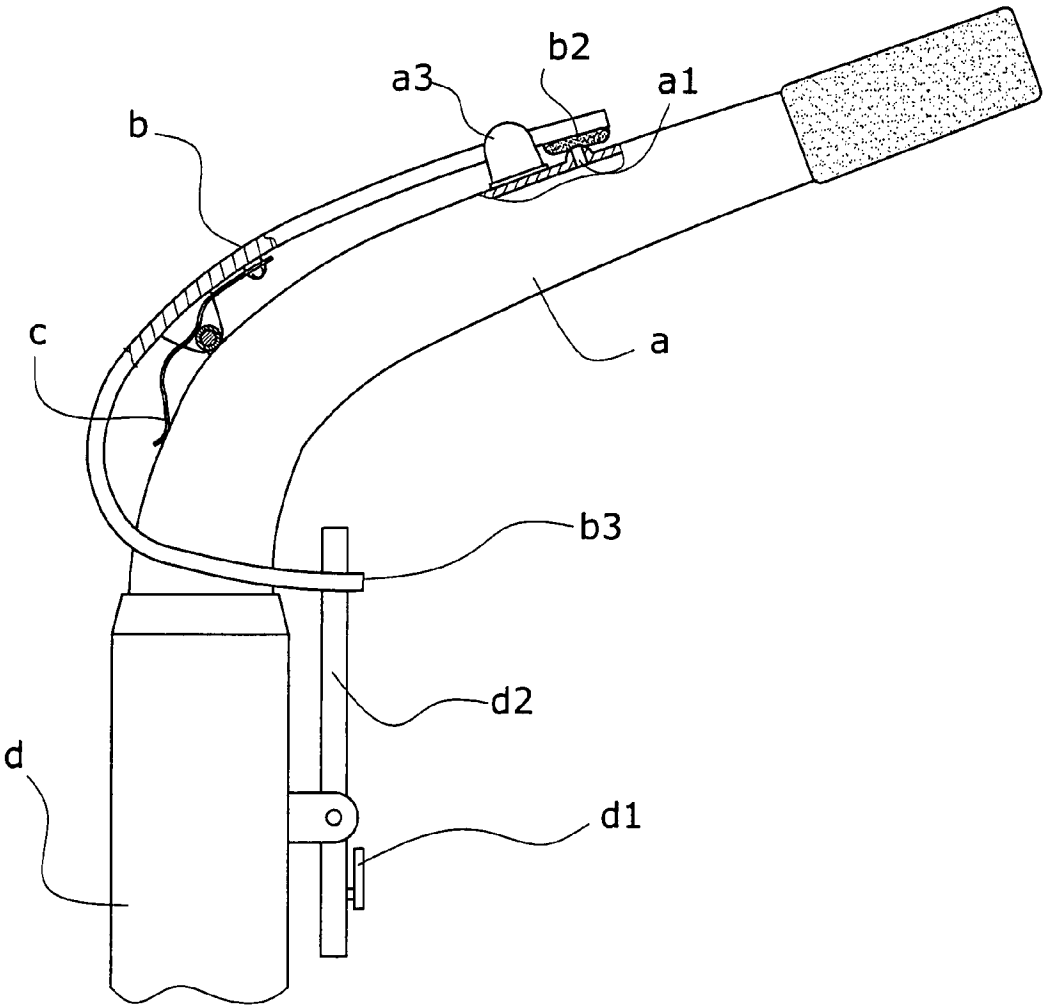
Fig.4 (Prior Art)
FIG. 4 is a schematic view of the conventional invention of the saxophone windpipe structure.

Referring to FIG. 3, according to the aforesaid structure, by pressing on the high pitch key 11, the push rod 12 will push the operating rod 3, which is pivotally supported by the inserting pin 201 thereby enabling a lower portion of the operating rod 3 to draw near the mouth-tube 2, due to the basic effect of Law of the Lever. Thus, due to the above drawing action, the spiral spring 34 will be compressed, causing an upper portion of the operating rod 3 to move away from the mouth-tube 2, as a result the key cover 31 is no longer pressed against the high pitch hole 21, emitting a high pitch. When the high pitch key 11 is released, a lower portion of the operating rod 3 will be pushed away from the mouth-tube 2 due to recoil action of the spiral spring 34, thereby enabling an upper portion of the operating rod 3 to move away from the mouth-tube 2, as a result the key cover 31 will be pressed against the high pitch hole 21, emitting the original low pitch.

Further, the invention can also be applied to the High D Key, High D# Key and High E Key of the saxophone, and the Register Key, C Trill Key, Bb Trill Key, A Key, F# Trill Key, Eb-Bb Trill Key of the clarinet, as well as the thumb key of the flute, etc.

In conclusion to the aforementioned structure, the structure and production process can be simplified, achieving decrease of capital, thus resulting in usability progress and improvement.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A saxophone windpipe structure comprising:

a mouth-pipe connecting to a tip of a saxophone wind tube, a high pitch hole and a tube seat is disposed on the mouth-pipe, an operating rod having two sides protruding downward at a middle portion where an ear seat is installed; a small aperture is formed on the ear seat where an inserting pin is inserted with the tube seat, further connecting the mouth-tube with the operating rod; a key cover is formed on an inner tip of the operating rod, wherein the key cover is pressed against a high pitch hole; a ring holder is formed on a base of the operating rod, whereby encircling a lower end of the mouth-tube; a push rod connecting a high pitch key is assembled on an upper side of the saxophone wind tube, wherein the push rod is leaned against an inner side of the ring holder; is characterized in that:

a cover tube having a spiral spring inserted therein, protruding downwards is installed on a lower portion corresponding to where the operating rod and the mouthpiece is connected; the spiral spring protrudes from the cover tube whilst leaning on an upper end of the mouth-tube.

* * * * *